United States Patent [19]

Akagi et al.

[11] 4,451,534

[45] May 29, 1984

[54] SYNTHETIC FIBERS IMPARTED WITH AN IRREGULAR SURFACE AND A PROCESS FOR THEIR PRODUCTION

[75] Inventors: Takao Akagi; Shinji Yamaguchi; Katsura Maeda, all of Kurashiki; Kazuo Yamamoto, Nishinomiya, all of Japan

[73] Assignee: Kuraray Co., Ltd., Kurashiki, Japan

[21] Appl. No.: 438,981

[22] Filed: Nov. 3, 1982

[30] Foreign Application Priority Data

Nov. 9, 1981 [JP] Japan ..... 56-180464

[51] Int. Cl.[3] ..... D02G 3/00

[52] U.S. Cl. ..... 428/372; 428/373; 428/374; 428/375; 428/379; 428/395; 428/400

[58] Field of Search ..... 428/372, 400, 375, 379, 428/373, 374, 394, 395, 384; 8/114.6, 115.5, DIG. 12; 156/628, 643; 250/492 R, 492 B; 204/192 E; 264/344

[56] References Cited

U.S. PATENT DOCUMENTS 4,198,459 4/1980 Brumlik ..... 428/400
4,254,182 3/1981 Yamaguchi et al. ..... 428/400

FOREIGN PATENT DOCUMENTS 951768 3/1964 United Kingdom .
2016364 9/1979 United Kingdom .

*Primary Examiner*—Lorraine T. Kendell
*Attorney, Agent, or Firm*—Barry Kramer

[57] ABSTRACT

A surface-modified synthetic fiber is provided by plasma irradiating a synthetic fiber containing fine particles. Recesses and projections are formed on the surface of the fiber. The recesses are formed by being etched with plasma in the portion not shielded by the fine particles; the projections are formed by not being etched in the portion shielded by the fine particles. The resulting fiber has an irregular surface such that the distance between the center points of adjacent projections is between approximately 0.03 and 1 microns and the number of projections is between approximately 1 and 200 per square micron.

6 Claims, No Drawings

SYNTHETIC FIBERS IMPARTED WITH AN IRREGULAR SURFACE AND A PROCESS FOR THEIR PRODUCTION

BACKGROUND OF THE INVENTION

1. Field of the Invention

This invention relates to synthetic fibers imparted with an irregular surface and a process for their production. In particular, the invention relates to synthetic fibers which produce an improved color in dyed products.

2. Description of the Prior Art

Various organic synthetic fibers, especially melt-spun synthetic fibers, have heretofore suffered disadvantages in that they exhibit a characteristic waxy hand and a specular gloss due to excessive smoothness of the fiber surface such that they cannot afford satisfactory depth of color as compared with wool, silk, etc.

Generally, it is believed that roughening of the fiber surface is a means for the improvement of luster or for the modification of hand and feel, and it is a common practice to deluster by adding fine particles of e.g. titanium oxide; however, it is well recognized that this method merely takes off the luster and actually deteriorates the coloring characteristics.

While the coloring characteristics, especially the depth of color and brilliance are necessary for fibers for use in any field, these characteristics are particularly important in black dyed products, e.g. formal wear. For such black dyed products obtaining both depth of color and brilliance has been very difficult in the past.

In particular, polyester synthetic fibers, which are most widely employed for their excellent functional characteristics, still have unsolved problems in the coloring characteristics as described above and those having both depth of color and brilliance have been continually, but unsuccessfully, sought.

In order to solve the aforesaid problems with synthetic fibers, various techniques have been presented.

The present inventors previously disclosed in, for example, U.S. Pat. No. 4,254,182 and British Pat. No. 2,016,364, a technique of forming specific irregularity on a fiber surface by alkali etching a polyester fiber containing inorganic fine particles and obtaining a color deepening effect by said irregular surface.

Also, Japanese Patent Application Laid-Open No. 99400/1977, assigned to the assignee of the present invention, discloses a technique of irradiating an organic synthetic fiber with plasma by glow discharge to form specific irregularity on a fiber surface and obtaining a color deepening effect by this irregularity.

Although the alkali technique is capable of imparting an excellent color deepening effect not previously achieved with available polyester fibers, the present invention imparts even further superior depth of color and brilliance of color owing to the difference of the production means as described hereinbelow.

On the other hand, the glow discharge plasma technique described in the Japanese Laid-Open Application, although similar to the present invention with regard to production means, relates to a technique of plasma irradiating an ordinary synthetic fiber, i.e., a synthetic fiber containing no fine particles, and hence the coloring characteristics obtained although somewhat improved are not satisfactory when compared with the fiber obtained by the alkali etching technique. By comparison, the present invention while similar to the Japanese Laid-Open Application in the point of use of plasma irradiation, unexpectedly produces a markedly superior color depth enhancing effect.

SUMMARY OF THE INVENTION

As can be understood from the foregoing, a primary object of this invention is to improve the depth of color or brilliance of color of dyed product by the surface conditions of a synthetic fiber. This invention satisfies this object by forming numerous nondirectional minute recesses and projections on the surface of a synthetic fiber. It achieves the formation of such numerous nondirectional minute recesses and projections by a plasma irradiation method.

A first aspect of the invention is a surface-modified synthetic fiber formed by plasma irradiating a synthetic fiber containing fine particles in which recesses and projections are formed on the surface of the synthetic fiber, said recesses being formed by being etched with plasma in the portion not shielded by the fine particles, said projections being formed by not being etched in the portion shielded by the fine particles, the synthetic fiber being imparted with an irregular surface such that the distance between the center points of adjacent projections is between approximately 0.03 and 1 microns and the number of projections is between approximately 1 and 200 per square micron.

Another aspect of the invention is a surface-modified synthetic fiber formed by plasma irradiating a synthetic fiber containing fine particles in a polymer substrate in which the substrate forms projections in a particulate form having the fine particles as cores on the surface of the fiber, the projections collectively create irregularity on the surface of the fiber, and the irregularity is such that the distance between the center points of adjacent projections is between approximately 0.03 and 1 microns and the number of said projections is between approximately 1 and 200 per square micron.

A further aspect of the invention is a process for producing a surface-modified synthetic fiber having an irregular surface which comprises low-temperature plasma irradiating a synthetic fiber containing fine particles in a polymer substrate to form projections in a particulate form of the polymer substrate having the fine particles as cores on the surface of the synthetic fiber, the particles having an average single particle size of less than about 200 millimicrons and being present in an amount between approximately 0.1% and 10% by weight.

DETAILED DESCRIPTION OF THE INVENTION

This invention relates generally to a method which comprises conducting low-temperature plasma irradiation upon a synthetic fiber having as many as possible fine particles dispersed and contained therein, and more specifically, it relates to a technique that uses the fine particles as shielding means against the plasma such that the substrate polymer portion not shielded by the fine particles is etched by the plasma, while the substrate polymer portion shielded by the fine particles is not etched and thus remains intact together with said fine particles, thereby producing numerous minute recesses and projections on the fiber surface.

The present inventors have discovered that when a conventional oriented synthetic fiber not containing the specified number or more of fine particles is plasma irradiated and its surface is observed on a scanning electron microscope, rippling wave-shaped or ridge shaped recesses and projections extending in the direction at a right angle to the fiber axis direction are formed, and such morphology and directional properties of these recesses and projections are very common with synthetic fibers obtained by melt-spinning. Further, also with wet-spun synthetic fibers and dry-spun synthetic fibers, it has been found that recesses and projections in a pattern short in the fiber axis direction and long in the direction at a right angle to the fiber axis direction are formed, even though they cannot be said to be uniform because of the structure on coagulation or solidification and the skin-core structure. The present inventors determined that these recesses and projections when optically observed cannot exert the same effect when the incident light comes in the fiber axis direction and when the incident light comes in the direction at a right angle to the fiber axis direction, and therefore that there is a limit to the improvement of the coloring characteristics.

The present invention is directed to overcoming this problem by making the structures in the fiber axis direction and in the direction at a right angle thereto as analogous as possible in respect to the etching behavior in plasma. It would be expected that when a fiber containing fine particles is plasma irradiated, the substrate constituting the fiber, as in the case where the fine particles are not contained, and the fine particles would be both etched to almost the same extent, and that eventually although recesses and projections due to the fine particles could be imparted, the fiber surface would only be given the aforesaid rippling wave-shaped irregular surface just the same as in the case where fine particles are not contained. On the contrary, however, when various fibers containing fine particles were prepared, plasma irradiated and then observed and analyzed, it was surprisingly discovered that the surface portion of the polymer substrate not shielded by the fine particles dissipates on plasma irradiation, whereas the fine particles and the polymer substrate portion shielded by said fine particles do not dissipate even on plasma irradiation and remain intact. As a result, an irregular structure is formed on the fiber surface, which structure consists of projections of the substrate portion in a particulate from having the non-dissipated, remaining fine particles as cores and recesses of the substrate portion which has been etched.

By such irregularity on the fiber surface, as well as by such nondirectional irregularity, and further by the size and density of such irregularity, and still further by the material itself of the fine particles, the depth of color has been found to be markedly an unexpectedly improved as compared with the case where an ordinary synthetic fiber containing no fine particles is plasma irradiated.

In other words, the first aspect of this invention is a surface-modified synthetic fiber obtained by plasma irradiating a synthetic fiber containing fine particles, in which the polymer substrate constituting the synthetic fiber forms projections in a particulate form having the fine particles as cores on the surface of said synthetic fiber and such projections collectively create irregularity on the surface of the synthetic fiber, said synthetic fiber being imparted with an irregular surface such that the distance between the center points of the adjacent projections forming said particulate-formed projections is approximately 0.03–1 micron and the number of said projections is approximately 1–200 per square micron.

The second aspect of this invention is a process for producing a surface-modified synthetic fiber imparted with an irregular surface, which process comprises low-temperature plasma irradiating a synthetic fiber containing fine particles having an average particle size of less than about 200 millimicrons in an amount of approximately 0.1–10% by weight to form projections in a particulate form of the polymer substrate having the fine particles as cores on the surface of the synthetic fiber.

The term "synthetic fiber" as used in this invention includes and means polyester, polyamide, acrylic, polyurethane and other synthetic fibers, and said synthetic fiber may also be, for example, a fiber partially containing a copolymer, a blend of two components or a laminate. Further, surfactants, delustering agents, pigments, etc., may also be incorporated.

The material to which the invention is applied in this specification is a synthetic fiber but the material to be plasma irradiated is not limited to tows, filaments, yarns and like filamentous products, but may be a knitted fabric or a woven textile obtained by knitting or weaving said fiber, or a non-woven cloth, or any other cloth-like two-dimensional product in any shape. Therefore, for the sake of simplicity of terminology, the material to which this invention is applied is merely termed a "synthetic fiber," but it should be understood that this includes synthetic fibers as well as structures of synthetic fibers.

The presence of the projections in the particulate form on the surface of the fiber in this invention may be distinctly recognized on a scanning electron microscope, and the substance which constitutes the cores in the particulate form may be recognized by, e.g., an electron spectrometer for chemical analysis (ESCA). By measurements using the ESCA, the surface of the fiber obtained by this invention can be characterized by defining the ratio of the number of the atoms of the fine particles present up to about 10 millimicrons in depth from the fiber surface to the number of the carbon atoms present in the fiber substance polymer before the irregularity-imparting treatment by plasma irradiation as $\alpha$, and defining the same ratio after the irregularity-imparting treatment by plasma irradiation as $\beta$. $\beta$ is always larger than $\alpha$, since by plasma irradiation, the concentration of the fine particles present on the fiber surface has become higher than the concentration of the fine particles within the fiber substrate polymer as originally dispersed and contained, that is, the fine particles do not dissipate but remain to contribute to the enhancement of the concentration. Further, it has also been ascertained that the color deepening effect of the fiber is increased as $\beta$ becomes greater than $\alpha$. The improvement of this color deepening effect becomes recognizable when $\beta$ is about 1.3 times as large as $\alpha$, and when $\beta$ becomes about 5 times as large as $\alpha$, its improving effect becomes even further clear.

The projections composed of the fine particles which have not dissipated but remain on the fiber substrate surface may be observed and measured by a photomicrograph obtained by photographing the fiber surface at a magnification of 10,000 or higher using a scanning electron microscope. It has been found that irregularity of approximately 0.03–1 micron on the fiber surface is effective in producing the color deepening effect. In this specification, the irregularity means the average value of the distance between the center (or the vicinity of the center) of a projection and the center (or the vicinity of the center) of the adjacent projection along the fiber axis direction, measured at 30 different points.

If this value is less than about 0.03 micron, the color deepening effect of the dyed product is small, whereas if larger than about 1 micron, the color deepening effect is not manifested either. Therefore, said irregularity is preferably in the range of approximately 0.03–1 micron, more preferable approximately 0.1–0.5 micron.

This irregularity is preferably such that the number of projections is approximately 1–200 per square micron. This measurement of the number is also done by using the photomicrograph of the fiber surface taken at a magnification of 10,000 or higher on a scanning electron microscope and counting the number of projections present within a square of 1 micron by 1 micron. If the number exceeds about 200, the shape of the irregularity is too small and hence the color deepening effect is small. Preferably, the number is between about 10 and 100.

Further, it is believed that the projections are formed, as described above, in such way that the fine particles have not been scattered on plasma irradiation but remain, and the polymer substrate takes a particulate form having said remaining fine particles as cores. Therefore, the kind of the fine particles constituting the projections in itself also influences the color deepening effect, and among the fine particles described hereinbelow, silica is most preferred in view of its low refractive index.

As to the process for the production of the fibers of this invention, the fibers may be obtained by preparing a synthetic fiber having fine particles dispersed and contained in the fiber substrate, and thereafter subjecting said synthetic fiber containing the fine particles to low-temperature plasma treatment before or after dyeing.

While the process for producing this synthetic fiber containing the fine particles may be a conventional method for adding additives to synthetic fibers, it is necessary to choose a means capable of adding the fine particles with good dispersibility and without coagulation. For example, in the case of a polyester fiber, the fine particles can generally be added before the completion of the polymerization reaction in the course of the polymer production. The details of this procedure appear in U.S. Pat. No. 4,254,182 and British Pat. No. 2,106,316 described hereinabove.

The fine particles used in this invention are required to be more unreactive and inert than the polymer substrate in the low-temperature plasma, and may be fine particles selected from the group consisting of silicon-containing inorganic particles, inorganic particles of an oxide of a Group II metal of the periodic table and/or a salt thereof, aluminum oxide, thorium oxide and zirconium oxide. The average single particle size should be less than about 200 millimicrons, preferably 150 millimicrons or less, more preferably 70 millimicrons or less. The amount to be added is about 0.1%–10% by weight, more preferable about 0.3%–5% by weight.

As already mentioned, the mechanism of the formation of irregularity according to this invention is presumably based on the fact that the surface portion of the polymer substrate not shielded by the fine particles dissipates on plasma irradiation and forms recesses whereas the fine particles contained in the substrate do not dissipate on plasma irradiation and remain on the surface of the substrate and so does the substrate portion shielded by the fine particles, thereby forming projections having said fine particles as cores. In other words, it is presumed that the fine particles dispersed throughout the substrate act as the shield for the substrate, and the portion having no such shield is gradually etched inward by plasma. Therefore, based on the above presumption, it is believed to be very important that as many possible fine particles should be present as uniformly as possible in the synthetic fiber substrate in order to form projections having a limited size. It has been ascertained that there is a good corelationship between the number of the fine particles and the color deepening effect. That is, supposing that the single particles of the fine particles are all spherical, and that said fine particles are completely uniformly dispersed in the polymer, the number of the fine particles present in a unit volume of the polymer may be counted, and according to this calculation, it has been found that the particle size of the fine particles and the amount thereof to be added to the polymer so as to represent at least $10^{13}/cm^3$, preferable $10^{14}/cm^3$ or more are in fair agreement with the particle size and the amount to be added which actually provide the color deepening effect. In other words, it has been found that in order to impart the color deepening effect by plasma irradiating a fiber containing fine particles, at least $10^{13}/cm^3$ of the fine particles must be uniformly dispersed in the fiber, preferably $10^{14}/cm^3$ or more.

The amount of the fine particles to be contained in the synthetic fiber is restricted from the standpoint of spinning stability, and there is an upper limit of addition, which is approximately 10% by weight. At this concentration, the upper limit for the average single particle size of the fine particles is 200 millimicrons or so. On the other hand, with decrease in the amount of addition, the particle size must be decreased accordingly. The smaller the particle size, the easier the fine particles tend to undergo second aggregation, and therefore the lower limit for the average single particle size is 5 millimicrons or so, and the addition of 0.1% by weight is the lower limit.

As described above, for dispersibility, the fine particles are best added during the production of the polymer. Colloidal silica is especially recommended in that it combines good dispersibility in organic polymers and a low refractice index. The color deepening effect of fibers containing silica has been found to be particularly striking. Colloidal silica consists of fine particles chiefly comprising silicon oxides present as colloids in a dispersion medium of water, a monofunctional alcohol, a diol, or a mixture thereof.

The low-temperature plasma treatment of fibers containing fine particles or of cloth-like two-dimensional products can be be done either before or after dyeing as described hereinabove. As is known, plasma is that state of a gas wherein the gas contains, in addition to neutral atoms, cations and a nearly corresponding number of anions or electrons, which state is obtained when a substrate is given a high energy and its molecules or atoms are dissociated. Usually, low-temperature plasma is generated under reduced pressure of 10 Torr or less.

As to the method for generating low-temperature plasmas, discharge by low frequency, high frequency or microwave under reduced pressure can be employed. As to the gas substrate for generating low-temperature plasma, oxygen, air, nitrogen, argon, olefins, etc. may be preferably employed.

As to the conditions for low-temperature plasma treatment, the type and shape of the device, the kind and flow rate of the gas, the degree of vacuum, the output, the treatment time etc. must be appropriately selected according to the material, composition and shape of the synthetic fiber intended and the desired degree of the depth of color. For example, the products obtained by this invention do not always need to be imparted with irregularity over the entire surface including both face and back sides of the fiber structure. Sometimes only one side is enough. In such a case, only the fiber surface exposed on one side need be imparted with irregularity and this may be achieved by suitable selecting the plasma treatment conditions. As between air, oxygen and argon for use as the gas for generating low-temperature plasma, it has been found that the order of preference for the color deepening effect is oxygen, air and argon, and thus the kind of gas is also influencial on the effect. It has also been discovered with regard to the flow rate of the gas that changing the flow rate while keeping the degree of vacuum constant effects the etching rate.

Further, although the plasma treatment itself may be conducted either before or after dyeing, conducting it before dyeing has a risk that the irregularity formed on the fiber surface might collapse during the subsequent dyeing process. Therefore conducting the etching after dyeing is preferred because of the absence of such a risk.

According to a further aspect of the invention, by shielding a part of the surface of the synthetic fiber to be irradiated so that a portion is plasma irradiated and a portion is not plasma irradiated when the low-temperature plasma irradiation is conducted, the pattern or color of the shielded portion may be made different from the pattern or color of the unshielded portion. The boundary between the shielded portion and the unshielded portion in this method is very distinct, and accordingly a very unique effect may be imparted to the dyed product.

As discussed above and illustrated in the examples below, it is believed necessary for this invention that the fiber to be plasma treated should be a fiber in which fine particles are present at least $10^{13}/cm^3$ in number, preferably $10^{14}/cm^3$ or more. By plasma treating a fiber which satisfies this requirement, a deeply dyed product having an unexpectedly deep shade and brilliance may be obtained. As a further aspect of the invention, it has been found that even greater enhancement of color deepening can be achieved by using as the fiber to be plasma treated a fiber obtained by surface dissolution treatment of a fiber containing fine particles, i.e. a fiber already imparted with an irregular surface. For example, fibers described in the aforesaid U.S. Pat. No. 4,452,182 or British Pat. No. 2,016,364 may be suitably employed. More particularly, although a fiber obtained by alkali treatment of a silica-containing polyester fiber and having a complicated and minute irregularity formed on its surface is an excellent deeply dyed product by itself, when this fiber is further plasma treated, a brilliant polyester fiber dyed product having an even higher purity deep shade, which looks like velvet, may be obtained. Among synthetic fibers, polyester fibers are the poorest in the depth of color and brilliance of a dyed product. The technique of this invention is particularly applicable to polyester fibers in that it shows a significant enhancement of the degree of color deepening in such fibers.

The polyester polymers referred to herein are those having repeating glycol dicarboxylate structural units of which at least about 75% are

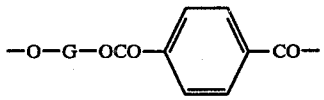

units wherein —G— represents a bivalent organic group containing 2–18 carbon atoms and bound to both adjacent oxygen atoms through saturated carbon atoms. Either the terephthalate group is the only dicarboxylate component of the repeating structural units or the repeating structural units may contain up to 25% adipate, sebacate, isophthalate, bibenzoate, hexahydroterephthalate, diphenoxyethane-4,4'-dicarboxylate, 5-sulfoisophthalate or other dicarboxylates. Glycols included are ethylene glycol, tetramethylene glycol, hexamethylene glycol and other polymethylene glycols, 2,2-dimethyl-1,3-propanediol and other branched-chain glycols, diethylene glycol, triethylene glycol, tetraethylene glycol, etc. Mixtures of these may also be used. If necessary, higher glycols such as high molecular weight polyethylene glycols may also be added in amounts of up to about 15% by weight.

Various other substances such as delustering agents, luster improving agents, discoloration inhibitors etc. may also be added to the polymerization mixtures, if necessary.

As can be understood from the foregoing, this invention attains the desired end by imparting the fiber surface with a specific structure, and this invention is, of course, applicable also to conjugate fibers having sheath-core or side-by-side structures. In these cases, even further enhanced characteristic features owing to the modification in hand and feel, gloss or quality feeling may also be realized by making a fiber composed of a sheath component or one side component consisting of a polymer containing fine particles as described above and a core component or the other side component consisting of a polymer of the same or different kind having a different content of said fine particles or a polymer of a different kind containing no fine particles, and thereafter plasma irradiating said fiber to give a synthetic fiber having recesses and projections on the fiber surface as described above.

Further, by coating the surface of the synthetic fiber of this invention with a composition having a refractive index lower than that of said synthetic fiber, the color characteristics, brilliance and depth of color of the dyed shade may be further enhanced, and at the same time their durability may be made semipermanent. While the synthetic fiber of this invention by itself already possesses coloring characteristics, brilliance and depth of color as described hereinabove, this means is an effective one to markedly improved durability of these effects.

Examples of the compositions having a low refractive index used in the above case include fluorine-containing compounds such as polytrifluoroethyl methacrylate, polytrifluorochloroethylene, polytrifluoroethyl acrylate, polytetrafluoroethylene, polypentadecafluorooctyl acrylate, tetrafluoroethylenehexafluoroprophlene copolymers etc., silicon compounds such as polydimethylsiloxane, polydimethylsilane etc., vinyl polymers such as polyvinyl acetate, polyvinyl formate, polyvinyl acetal, polyvinyl alcohol etc., methacrylic acid ester polymers such as poly-tertiarybutyl methacrylate, polyisobutyl methacrylate, poly-n-propyl methacrylate, polyethyl methacrylate, polymethyl methacrylate etc., acrylic acid ester polymers such as polybutyl acrylate, polyethyl acrylate, polymethyl acrylate etc., vinyl ether polymers such as polyvinyl isobutyl ether, polyvinyl ethyl ether etc., and the like. Combination of more than one kind may also be employed. In order to enhance the hardness of the film, fine particles may also be contained in the film. Of course, for better coloring characteristics, the fine particles desirably also have a low refractive index. Further, a plasma polymerized film may be formed on the fiber surface using, for example, perfluorobutene-2 etc. as a monomer.

For forming the polymerized film, there are two processes: one comprising, after plasma etching, introducing a monomer while the radicals still remain, and the other comprising, after plasma etching, introducing a monomer under discharge conditions to effect plasma polymerization.

The methods for attaching the composition of a low refractive index includes the impregnation method, the pad method, the pad-steam method, the spray method, the plasma method etc. The impregnation method is preferred in view of the deposit control and operativity, whereas the plasma method is desired in view of durability of the film.

If the content of the resin of a low refractive index is 0.1% or less based on the fiber structure, a uniform film is not formed on the fiber surface and the degree of improvement of coloring characteristics is also not effected. On the other hand, if the content of the resin of a low refractive index is 7.0% or higher based on the fiber structure, the hand and feel of the fiber structure becomes too stiff and hence not attractive in quality.

It is of course understood that the process of this invention is applicable to cases where the fiber has a cross-section resembling a pentagon or hexagon as the result of yarn treatment such as false twisting and to cases where the fiber cross-section has e.g. a polyfolious form such as tri-, tetra-, penta-, hexa-, hepta- and octafolious forms, T-shaped form or the like as the result of spinning through a spinnert having modified cross-sectional holes.

The false-twisted yarn according to this invention also manifests an effect to reduce glittering. Therefore, this invention has the additional advantage of exhibiting an antiglitter effect upon draw, textured yarn of preoriented yarns obtained by high-speed spinning.

The invention is further illustrated by the following examples, which are not to be construed as limiting the present invention.

EXAMPLES A-1 TO A-9 AND COMPARISONS A-10 TO A-14

In a process comprising mixing an aqueous silica sol of a concentration of 20% by weight and having an average single particle size of 45 millimicrons with ethylene glycol at room temperature, stirring the mixture sufficiently, then mixing with terephthalic acid, and effecting direct polymerization to obtain a silica-containing polymer, various different amounts of the aqueous silica sol were employed to obtain polyethylene terephthalate polymers having an inherent viscosity [$\eta$] of 0.69 and having the different silica contents set forth in Table 1, respectively. Also as Comparisons, a polymer having an inherent viscosity [$\eta$] of 0.69 but containing no silica and a polymer having an inherent viscosity [$\eta$] of 0.69 and containing 0.45% by weight of titanium dioxide of an average single particle size of 200 millimicrons instead of the silica sol were obtained similarly. Each obtained polymer was spun and drawn in conventional manner to obtain a spherical cross-sectional fiber of 150 denier/36 filaments. Then, the filaments of each were spun into 150 denier and true-twisted both in the S and Z directions at 2100 times/m and heat-set. The obtaining yarns were used as the warp and the weft respectively to make "chirimen" georgette. The fabrics were creped, heat-set and some were treated with a 40 g/l aqueous solution of sodium hydroxide, which is a solvent for both silica and polyester, at 98° C. to attain a loss in weight of 25%, and the rest were not treated. Thereafter, each fabric was dyed using 12% o.w.f. of Kayalon Polyester Black G-SF (supplied by Nippon Kayaku) as a dye, 0.5 g/l of Tohosalt TD (surfactant supplied by Toho Chemical) as a dispersant and 0.7 g/l of Ultra Mt-$N_2$ (mixed solution of acetic acid and sodium acetate supplied by Daiwa Chemical) as a pH adjusting agent at 135° C. and then reduced washed using 1 g/l of hydrosulfite, 1 g/l of caustic soda and 1 g/l of a nonionic surfactant at 80° C. for 10 minutes to obtain a black-dyed product. A-9 and A-14 were not subjected to the above dyeing. The depths of color of the dyed products are set forth in Table 1.

Each obtained fabric was then placed in an internal electrode type plasma apparatus (electrode surface area of 50 $cm^2$), and irradiated at a frequency of 13.56 Hz, using air as the gas to be introduced, a vacuum of $10^{-2}$ Torr and an output of 50 W for 5 minutes. The depths of color of the obtained products are shown in Table 1. The two undyed examples were then dyed after the plasma irradiation. The depth of color of the dyed product is expressed as Value L* in the L*a*b* expression system and this means the smaller L* the better the color deepening effect.

As demonstrated in Table 1, in the cases where fine particles were not used (A-10 and A-11) and in the cases of ordinary semi-dull yarns where the fine particles were titanium oxide (A-12 and A-13), the depths of color L* were 14.4–14.6 and the depths of color L* of these fibers after plasma irradiation were slightly enhanced to 10.5–10.8. Observation of these fiber surfaces on a scanning electron microscope revealed that they had rippling wave-shaped irregularity of 0.1–0.3 micron in the fiber axis direction and 0.5–1.0 micron in the direction at a right angle to the fiber axis.

On the other hand, for A-1 and A-7, which contained silica as the fine particles and which were treated with alkali for weight loss and thus were already imparted with a somewhat irregular surface before plasma irradiation, the depths of color L* of the dyed products prior to plasma irradiation were 12.7–14.2, and the depths of color L* after plasma irradiation were 4.0–10.0, thus indicating a remarkable color deepening effect as compared with Comparisons A-10 to A-14.

Also, A-8, which contained silica and, without alkali treatment, was plasma irradiated, similarly exhibited a remarkable color deepening effect as compared with A-10 and A-12.

Further, A-9, on which dyeing was effected after plasma irradiation, showed a comparable color deepening effect to the case of A-3. The results of observation of fibers A-1 to A-9 on a scanning electron microscope were such that the fiber surface had nondirectional particulate-formed recesses and projections and the average distance between the adjacent apexes of the projections was 0.1–0.3 micron.

As the result of the surface analysis of A-1 to A-9 using an ESCA, the $\beta/\alpha$ values were 1.3–15, whereas those of A-12 to A-14 were only 1.2 or less.

TABLE 1

| | Polymer | | | | Processing | | | Color |
|---|---|---|---|---|---|---|---|---|
| | Polymer | Fine Particles | Average Particle Size (mμ) | Amount Added (wt %) | Structure | Weight Loss (%) | Dyeing | Deepening Effect (L*) |
| Example | | | | | | | | |
| A-1 | PET | $SiO_2$ Sol | 45 | 10 | "Chirimen" georgette | 25 | Black | 12.8 |
| A-2 | " | $SiO_2$ Sol | " | 5 | "Chirimen" georgette | " | " | 12.7 |
| A-3 | " | $SiO_2$ Sol | " | 3 | "Chirimen" georgette | " | " | 12.8 |
| A-4 | " | $SiO_2$ Sol | " | 2 | "Chirimen" georgette | " | " | 13.1 |
| A-5 | " | $SiO_2$ Sol | " | 1 | "Chirimen" georgette | " | " | 13.8 |
| A-6 | " | $SiO_2$ Sol | " | 0.5 | "Chirimen" georgette | " | " | 14.0 |
| A-7 | " | $SiO_2$ Sol | " | 0.1 | "Chirimen" georgette | " | " | 14.2 |
| A-8 | " | $SiO_2$ Sol | " | 3 | "Chirimen" georgette | 0 | " | 14.5 |
| A-9 | " | $SiO_2$ Sol | " | 3 | "Chirimen" georgette | 25 | Before Dyeing | — |
| Comparison | | | | | | | | |
| A-10 | " | — | — | — | "Chirimen" georgette | 0 | Black | 14.6 |
| A-11 | " | — | — | — | "Chirimen" georgette | 25 | " | 14.5 |
| A-12 | " | $TiO_2$ | 200 | 0.45 | "Chirimen" georgette | 0 | " | 14.6 |
| A-13 | " | " | " | " | "Chirimen" georgette | 25 | " | 14.4 |
| A-14 | " | " | " | " | "Chirimen" georgette | " | Before Dyeing | — |

| | Plasma Conditions | | | | | Color Deepening Effect (L*) | $\beta/\alpha$ |
|---|---|---|---|---|---|---|---|
| | Apparatus | Gas | Degree of Vacuum (Torr) | Output (W) | Irradiation Time (min) | | |
| Example | | | | | | | |
| A-1 | Internal Electrode 13.56 MHz | Air | $10^{-2}$ | 50 | 5 | 4.0 | 15 |
| A-2 | Internal Electrode 13.56 MHz | " | " | " | " | 5.8 | 12 |
| A-3 | Internal Electrode 13.56 MHz | " | " | " | " | 6.5 | 10 |
| A-4 | Internal Electrode 13.56 MHz | " | " | " | " | 7.0 | 9.5 |
| A-5 | Internal Electrode 13.56 MHz | " | " | " | " | 8.5 | 8 |
| A-6 | Internal Electrode 13.56 MHz | " | " | " | " | 9.0 | 5 |
| A-7 | Internal Electrode 13.56 MHz | " | " | " | " | 10.0 | 1.3 |
| A-8 | Internal Electrode 13.56 MHz | " | " | " | " | 7.0 | 9 |
| A-9 | Internal Electrode 13.56 MHz | " | " | " | " | 6.5 | 10 |
| Comparison | | | | | | | |
| A-10 | Internal Electrode 13.56 MHz | " | " | " | " | 10.4 | |
| A-11 | Internal Electrode 13.56 MHz | " | " | " | " | 10.5 | |

TABLE 1-continued

| | | | | | | | |
|---|---|---|---|---|---|---|---|
| A-12 | Internal Electrode 13.56 MHz | " | " | " | " | 10.6 | 1.2 |
| A-13 | Internal Electrode 13.56 MHz | " | " | " | " | 10.6 | 1.2 |
| A-14 | Internal Electrode 13.56 MHz | " | " | " | " | 10.8 | 1.2 |

EXAMPLES B-1 TO B-9 AND COMPARISONS B-10 AND B-11

Using various silica sols having different single particle sizes and fine particles other than silica, polymers were prepared, spun and drawn following the procedures in Examples A. As comparisons, polymers were similarly prepared, spun and drawn in a case where no fine particles were added and a case of a semi-dull yarn where 0.45% by weight of titanium oxide of an average single particle size of 200 millimicrons was added.

These yarns were then false-twisted in conventional manner to prepare cashmere "dosukin" fabrics. The dyeing method and the plasma irradiation conditions were the same as in Examples A. The results are given in Table 2.

As demonstrated by cases B-1 to B-5 where the average single particle sizes were changed from 7, through 10–20, 40–60, 80–90 and 120–150 microns, as the particle size is reduced, the color deepening effect is increased. This means that the formation of recesses and projections after plasma irradiation is influenced by the number of the fine particles present as the cores of the irregular surface. Observation of these fiber surfaces on a scanning electron microscope revealed that all the cases show nondirectional particulate-formed recesses and projections, and that the less the particle size of silica (i.e. the greater the number of the particles), the more minute and the more plentiful were the particulate-formed recesses and projections formed.

For reference, Table 2 includes the calculated values of the particle numbers calculated from the amounts added, based on the presumption that the particles are present as complete single particles. It can be seen that the cases where the particle numbers were $10^{13}/cm^3$ or more according to this calculation correspond to the cases where favorable results are obtained.

The cases where particles other than silica were used are shown as cases B-5 to B-9. Comparison was made between silica and titanium oxide of an average single particle size of 30 millimicrons, alumina of 100 millimicrons, calcium carbonate of 80–100 millimicrons and carbon of 50 millimicrons. Each of these cases exhibit a remarkable improvement of the color deepening effect as compared with case B-10, where no fine particles were used, and case B-11, the semi-dull yarn. When compared with the yarns containing silica, however, their color deepening effect is somewhat poorer. Although the reason for this difference has not yet been completely clarified, the refractive index of the fine particles, their dispersed conditions etc. are believed to contribute to the effect observed. When these fiber surfaces were observed on a scanning electron microscope, although they had the same particulate form as in the cases where silica was added, the recesses and projections in the particulate form were somewhat larger and accordingly less in number. The surfaces of B-10 and B-11 were of the so-called rippling wave-shaped form.

TABLE 2

| | Polymer | | | | Processing | | | Color |
|---|---|---|---|---|---|---|---|---|
| | Polymer | Fine Particles | Average Particle Size (mμ) | Amount Added (wt %) | Structure | Weight Loss (%) | Dyeing | Deepening Effect (L*) |
| Example | | | | | | | | |
| B-1 | PET | $SiO_2$ Sol | 10–20 | 3 | Cashmere "Dosukine" | 0 | Black | 16.7 |
| B-2 | " | $SiO_2$ Sol | 40–60 | " | Cashmere "Dosukine" | " | " | 16.7 |
| B-3 | " | $SiO_2$ Sol | 80–90 | " | Cashmere "Dosukine" | " | " | 16.7 |
| B-4 | " | $SiO_2$ Sol | 120–150 | " | Cashmere "Dosukine" | " | " | 16.8 |
| B-5 | " | $SiO_2$ Powder | 7 | " | Cashmere "Dosukine" | " | " | 16.7 |
| B-6 | " | $TiO_2$ Fine Powder | 30 | 1.5 | Cashmere "Dosukine" | " | " | 16.8 |
| B-7 | " | Alumina Powder | 100 | 2 | Cashmere "Dosukine" | " | " | 16.7 |
| B-8 | " | $CaCO_3$ | 80–100 | 3 | Cashmere "Dosukine" | " | " | 16.8 |
| B-9 | " | Carbon | 50 | 2 | Cashmere "Dosukine" | " | " | 16.5 |
| Comparison | | | | | | | | |
| B-10 | PET | — | — | — | Cashmere "Dosukine" | 0 | Black | 16.8 |
| B-11 | " | $TiO_2$ | 200 | 0.45 | Cashmere "Dosukine" | " | " | 16.9 |

TABLE 2-continued

| | Plasma Conditions | | | | | | |
|---|---|---|---|---|---|---|---|
| | Apparatus | Gas | Degree of Vacuum (Torr) | Output (W) | Irradiation Time (min) | Color Deepening Effect (L*) | Cal'd Particle # (#/cm$^3$) |
| Example | | | | | | | |
| B-1 | Internal Electrode 13.56 MHz | Air | $10^{-2}$ | 50 | 5 | 8.0 | $4 \times 10^{16}$ |
| B-2 | Internal Electrode 13.56 MHz | " | " | " | " | 9.5 | $4 \times 10^{14}$ |
| B-3 | Internal Electrode 13.56 MHz | " | " | " | " | 10.5 | $6 \times 10^{13}$ |
| B-4 | Internal Electrode 13.56 MHz | " | " | " | " | 11.0 | $2 \times 10^{13}$ |
| B-5 | Internal Electrode 13.56 MHz | " | " | " | " | 7.5 | $1 \times 10^{17}$ |
| B-6 | Internal Electrode 13.56 MHz | " | " | " | " | 12.0 | |
| B-7 | Internal Electrode 13.56 MHz | " | " | " | " | 12.5 | |
| B-8 | Internal Electrode 13.56 MHz | " | " | " | " | 12.0 | |
| B-9 | Internal Electrode 13.56 MHz | " | " | " | " | 12.0 | |
| Comparison | | | | | | | |
| B-10 | Internal Electrode 13.56 MHz | Air | $10^{-2}$ | 50 | 5 | 14.0 | |
| B-11 | Internal Electrode 13.56 MHz | " | " | " | " | 14.2 | $8 \times 10^{11}$ |

EXAMPLES C-1 TO C-10 AND COMPARISONS C-11 TO C-20

By the same procedures as in Examples A, drawn yarns having 3% by weight of silica or 0.45% by weight of titanium oxide incorporated were obtained. Thereafter, chiffon georgette fabrics were prepared in the conventional manner. After alkali treatment to reduce the weight by 25% by weight using the same conditions as in Examples A, the fabrics were dyed using various dyestuffs to various shades, in addition to black. Then, plasma irradiation was conducted under the same conditions as in Examples A, using irradiation times of 5 and 20 minutes. The results are given in Table 3.

The depth of color L* before plasma irradiation is lower in cases C-1 to C-10 as compared with cases C-11 to C-20 due to the color deepening effect discloses in the U.S. Pat. No. 4,254,182 and British Pat. No. 2,016,364. As can be seen from this table, when the fibers containing silica particles are plasma irradiated, a remarkable effect was exerted on the color deepening effect. The effect on depth of color and brilliances was especially striking. Furthermore, it was found that when the plasma irradiation time was as long as 20 minutes, the colors exhibited were those of velvets.

By microscopic observation of the fiber surfaces using a scanning electron microscope, it was found that the surfaces had perfect particulate-formed recesses and projections. The projections were about 0.2–0.3 micron in size and $25/\mu^2$ in number. In the case of 20 minutes irradiation, observation of ultra-thin cross-sections using a transmission type electron microscope revealed that the depth of the irregularities was on the order of 0.5–1.0 micron. On the other hand, the results of observation of the fibers of C-11 to C-20 on a scanning electron microscope showed that the size of the irregularity was 0.1–0.2 micron in the fiber axis direction and 0.3–0.8 micron in the direction at a right angle to the fiber axis and it had a rippling-wave shape, with a frequency of $10/\mu^2$ in number.

TABLE 3

| | Polymer | | | | Processing | | | |
|---|---|---|---|---|---|---|---|---|
| | Polymer | Fine Particles | Average Particle Size (mμ) | Amount Added (wt %) | Structure | Weight Loss (%) | Dyeing | Color Deepening Effect (L*) |
| Example | | | | | | | | |
| C-1 | PET | $SiO_2$ Sol | 45 | 3 | Chiffon georgette | 25 | Black | 13.5 |
| C-2 | " | $SiO_2$ Sol | " | " | Chiffon georgette | " | " | " |
| C-3 | " | $SiO_2$ | " | " | Chiffon | " | Navy | 14.3 |

TABLE 3-continued

| | | | | | | | | |
|---|---|---|---|---|---|---|---|---|
| C-4 | " | Sol $SiO_2$ | " | " | georgette Chiffon | " | " | " |
| C-5 | " | Sol $SiO_2$ | " | " | georgette Chiffon | " | Brown | 17.5 |
| C-6 | " | Sol $SiO_2$ | " | " | georgette Chiffon | " | " | " |
| C-7 | " | Sol $SiO_2$ | " | " | georgette Chiffon | " | Rouge | 32.7 |
| C-8 | " | Sol $SiO_2$ | " | " | georgette Chiffon | " | " | " |
| C-9 | " | Sol $SiO_2$ | " | " | georgette Chiffon | " | Green | 40.0 |
| C-10 | " | Sol $SiO_2$ | " | " | georgette Chiffon | " | " | " |
| Comparison | | | | | | | | |
| C-11 | PET | $TiO_2$ | 200 | 0.45 | Chiffon | 25 | Black | 15.5 |
| C-12 | " | " | " | " | georgette Chiffon | " | " | " |
| C-13 | " | " | " | " | georgette Chiffon | " | Navy | 16.0 |
| C-14 | " | " | " | " | georgette Chiffon | " | " | " |
| C-15 | " | " | " | " | georgette Chiffon | " | Brown | 19.1 |
| C-16 | " | " | " | " | georgette Chiffon | " | " | " |
| C-17 | " | " | " | " | georgette Chiffon | " | Rouge | 35.3 |
| C-18 | " | " | " | " | georgette Chiffon | " | " | " |
| C-19 | " | " | " | " | georgette Chiffon | " | Green | 45.7 |
| C-20 | " | " | " | " | georgette Chiffon | " | " | " |

| | Plasma Conditions | | | | | |
|---|---|---|---|---|---|---|
| | Apparatus | Gas | Degree of Vacuum (Torr) | Output (W) | Irradiation Time (min) | Color Deepening Effect (L*) |
| Example | | | | | | |
| C-1 | Internal Electrode 13.56 MHz | Air | $10^{-2}$ | 50 | 5 | 7.0 |
| C-2 | Internal Electrode 13.56 MHz | " | " | " | 20 | 1.5 |
| C-3 | Internal Electrode 13.56 MHz | " | " | " | 5 | 8.1 |
| C-4 | Internal Electrode 13.56 MHz | " | " | " | 20 | 2.5 |
| C-5 | Internal Electrode 13.56 MHz | " | " | " | 5 | 12.0 |
| C-6 | Internal Electrode 13.56 MHz | " | " | " | 20 | 10.5 |
| C-7 | Internal Electrode 13.56 MHz | " | " | " | 5 | 27.0 |
| C-8 | Internal Electrode 13.56 MHz | " | " | " | 20 | 24.0 |
| C-9 | Internal Electrode 13.56 MHz | " | " | " | 5 | 34.0 |
| C-10 | Internal Electrode 13.56 MHz | " | " | " | 20 | 30.0 |
| Comparison | | | | | | |
| C-11 | Internal Electrode 13.56 MHz | Air | $10^{-2}$ | 50 | 5 | 11.6 |
| C-12 | Internal Electrode 13.56 MHz | " | " | " | 20 | 10.0 |
| C-13 | Internal Electrode | " | " | " | 5 | 12.2 |

TABLE 3-continued

| | | | | | | |
|---|---|---|---|---|---|---|
| C-14 | 13.56 MHz Internal Electrode 13.56 MHz | " | " | " | 20 | 10.5 |
| C-15 | 13.56 MHz Internal Electrode 13.56 MHz | " | " | " | 5 | 15.1 |
| C-16 | 13.56 MHz Internal Electrode 13.56 MHz | " | " | " | 20 | 13.4 |
| C-17 | 13.56 MHz Internal Electrode 13.56 MHz | " | " | " | 5 | 31.7 |
| C-18 | 13.56 MHz Internal Electrode 13.56 MHz | " | " | " | 20 | 29.9 |
| C-19 | 13.56 MHz Internal Electrode 13.56 MHz | " | " | " | 5 | 41.0 |
| C-20 | 13.56 MHz Internal Electrode 13.56 MHz | " | " | " | 20 | 37.0 |

EXAMPLES D-1 TO D-5 AND COMPARISONS D-6 TO D-10

Fibers containing 3% by weight of silica or 0.45% by weight of titanium oxide were prepared under the same conditions as in Examples A, and plain fabrics were fabricated therefrom. These fabrics were alkali treated and dyed under the same conditions as in Examples A. Plasma irradiation was conducted using 13.56 MHz high-frequency external electrode type apparatus having an electrode surface area of 50 $cm^2$, a degree of vacuum of $10^{-2}$ Torr, and an output of 75 watts. An irradiation time of 5 minutes was used with various different gases of air, nitrogen, oxygen, argon and carbon dioxide. The depths of color are given in Table 4.

As shown in this table, the fibers containing fine particles exhibit remarkable color deepening effects regardless of the kind of gas. The amount of color deepening effect was found to vary among the different gases both for cases D-1 to D-5 and in the case of the semi-dull yarns, D-6 to D-10. Among the gases, oxygen and air were found especially effective due to a great etching rate.

TABLE 4

| | Polymer | | | | Processing | | | |
|---|---|---|---|---|---|---|---|---|
| | Polymer | Fine Particles | Average Particle Size (mμ) | Amount Added (wt %) | Structure | Weight Loss (%) | Dyeing | Color Deepening Effect (L*) |
| Example | | | | | | | | |
| D-1 | PET | $SiO_2$ Sol | 45 | 3 | Taffeta | 15 | Black | 19.1 |
| D-2 | " | $SiO_2$ Sol | " | " | " | " | " | " |
| D-3 | " | $SiO_2$ Sol | " | " | " | " | " | " |
| D-4 | " | $SiO_2$ Sol | " | " | " | " | " | " |
| D-5 | " | $SiO_2$ Sol | " | " | " | " | " | " |
| Comparison | | | | | | | | |
| D-6 | PET | $TiO_2$ | 200 | 0.08 | Taffeta | 15 | Black | 22.9 |
| D-7 | " | " | " | " | " | " | " | " |
| D-8 | " | " | " | " | " | " | " | " |
| D-9 | " | " | " | " | " | " | " | " |
| D-10 | " | " | " | " | " | " | " | " |

| | Plasma Conditions | | | | | |
|---|---|---|---|---|---|---|
| | Apparatus | Gas | Degree of Vacuum (Torr) | Output (W) | Irradiation Time (min) | Color Deepening Effect (L*) |
| Example | | | | | | |
| D-1 | External Electrode 13.56 MHz | Air | $10^{-2}$ | 75 | 5 | 13.0 |
| D-2 | External Electrode 13.56 MHz | $N_2$ | " | " | " | 13.4 |
| D-3 | External Electrode 13.56 MHz | $O_2$ | " | " | " | 11.8 |
| D-4 | External Electrode 13.56 MHz | Ar | " | " | " | 14.5 |

TABLE 4-continued

| | | | | | | |
|---|---|---|---|---|---|---|
| D-5 | External Electrode 13.56 MHz | $CO_2$ | " | " | " | 13.5 |
| Comparison | | | | | | |
| D-6 | External Electrode 13.56 MHz | Air | $10^{-2}$ | 75 | 5 | 18.5 |
| D-7 | External Electrode 13.56 MHz | $N_2$ | " | " | " | 19.0 |
| D-8 | External Electrode 13.56 MHz | $O_2$ | " | " | " | 17.0 |
| D-9 | External Electrode 13.56 MHz | Ar | " | " | " | 20 |
| D-10 | External Electrode 13.56 MHz | $CO_2$ | " | " | " | 19.1 |

EXAMPLES E-1 TO E-6 AND COMPARISONS E-7 TO E-8

Fibers containing 3% by weight of silica or 0.45% by weight of titanium oxide were prepared under the same conditions as in Examples A. Thereafter, they were false-twisted in the conventional manner, and woven to tropical fabrics, followed by dyeing under the same conditions as in Examples A. Plasma irradiation was conducted using 13.56 MHz high-frequency internal electrode type apparatus, an electrode surface area of 50 $cm^2$, a gas of air and an irradiation time of 5 minutes with various degrees of vacuum and outputs. The results are given in Table 5.

It can be seen that the fibers containing silica were always remarkably greater in depth of color regardless of the degree of vacuum and the output. Where the gas is air, it is believed desirable that the degree of vacuum is $10^{-2}$–$5\times10^{-1}$ Torr and the output is 50 watts/50 $cm^2$ or so.

Observation of the fiber surfaces of cases E-1 to E-6 using a scanning electron microscope revealed that the surfaces all had a particulate form of a similar size. The depths of irregularity in the cases of the greater color deepening effects, however, seemed deeper. On the other hand, the fiber surfaces of Comparisons E-7 to E-12 had a rippling wave-shaped form. As shown in Tables 4 and 5, the plasma irradiation conditions can be optimized, depending on the apparatus, by varying the gas, degree of vacuum, output etc.

TABLE 5

| | Polymer | | | | Processing | | | |
|---|---|---|---|---|---|---|---|---|
| | Polymer | Fine Particles | Average Particle Size (mμ) | Amount Added (wt %) | Structure | Weight Loss (%) | Dyeing | Color Deepening Effect (L*) |
| Example | | | | | | | | |
| E-1 | PET | $SiO_2$ Sol | 45 | 3 | Tropical | 0 | Black | 17.5 |
| E-2 | " | $SiO_2$ Sol | " | " | " | " | " | " |
| E-3 | " | $SiO_2$ Sol | " | " | " | " | " | " |
| E-4 | " | $SiO_2$ Sol | " | " | " | " | " | " |
| E-5 | " | $SiO_2$ Sol | " | " | " | " | " | " |
| E-6 | " | $SiO_2$ Sol | " | " | " | " | " | " |
| Comparison | | | | | | | | |
| E-7 | PET | $TiO_2$ | 200 | 0.45 | Tropical | 0 | Black | 17.5 |
| E-8 | " | " | " | " | " | " | " | " |
| E-9 | " | " | " | " | " | " | " | " |
| E-10 | " | " | " | " | " | " | " | " |
| E-11 | " | " | " | " | " | " | " | " |
| E-12 | " | " | " | " | " | " | " | " |

| | Plasma Conditions | | | | | |
|---|---|---|---|---|---|---|
| | Apparatus | Gas | Degree of Vacuum (Torr) | Output (W) | Irradiation Time (min) | Color Deepening Effect (L*) |
| Example | | | | | | |
| E-1 | Internal Electrode 13.56 MHz | Air | $10^0$ | 50 | 5 | 13.9 |
| E-2 | Internal Electrode 13.56 MHz | " | $10^{-1}$ | " | " | 10.3 |

TABLE 5-continued

| | | | | | | |
|---|---|---|---|---|---|---|
| E-3 | Internal Electrode 13.56 MHz | " | $10^{-2}$ | " | " | 11.9 |
| E-4 | Internal Electrode 13.56 MHz | " | $10^{0}$ | 25 | " | 13.4 |
| E-5 | Internal Electrode 13.56 MHz | " | $10^{-2}$ | " | " | 13.0 |
| E-6 | Internal Electrode 13.56 MHz | " | $10^{-2}$ | 75 | " | 14.1 |
| Comparison | | | | | | |
| E-7 | Internal Electrode 13.56 MHz | Air | $10^{0}$ | 50 | 5 | 16.2 |
| E-8 | Internal Electrode 13.56 MHz | " | $10^{-1}$ | " | " | 14.0 |
| E-9 | Internal Electrode 13.56 MHz | " | $10^{-2}$ | " | " | 14.7 |
| E-10 | Internal Electrode 13.56 MHz | " | $10^{0}$ | 25 | " | 15.8 |
| E-11 | Internal Electrode 13.56 MHz | " | $10^{-2}$ | " | " | 15.3 |
| E-12 | Internal Electrode 13.56 MHz | " | $10^{-2}$ | 75 | " | 15.9 |

EXAMPLES F-1 TO F-6 AND COMPARISONS F-7 TO F-12

According to the conventional method for adding delustering agents for polymers, various polymers containing 3% by weight of silica of an average single particle size of 45 millimicrons or 0.08–0.45% by weight of titanium oxide of an average single particle size of 200 millimicrons were delustered. These polymers were spun and drawn, and the obtained 75 denier/36 filaments were woven into pear-skin georgette in conventional manner, followed by alkali treatment, dyeing and plasma irradiation under the same conditions as in Examples A, except the irradiation time was 7 minutes. The depths of color are given in Table 6. The depth of color L* before plasma irradiation is lower in cases F-1 to F-6 due to the color deepening effect disclosed in U.S. Pat. No. 4,254,182 and British Pat. No. 2,016,364.

As can be seen from Table 6, the effect of this invention is manifested where fine particles are contained regardless of the kind of polymer or whether a copolymer was used. Observation of the fiber surfaces of F-1 to F-6 using a scanning electron microscope revealed that all had a particulate-formed recesses and projections. On the other hand, with F-7 to F-12, a rippling wave-shaped form in the direction at a right angle to the fiber axis was observed.

In Example F-6, the plasma irradiation was conducted with a part of the black dyed product shielded with plate glass. The portion shielded retained the same depth of color as that after dyeing, whereas the unshielded part significantly increased its depth of color. The boundary between the two regions was very distinct and a pattern exactly the same as that of the plate glass was formed.

TABLE 6

| | Polymer | | | | Processing | | | |
|---|---|---|---|---|---|---|---|---|
| | Polymer | Fine Particles | Average Particle Size (mμ) | Amount Added (wt %) | Structure | Weight Loss (%) | Dyeing | Color Deepening Effect (L*) |
| Example | | | | | | | | |
| F-1 | SIP 2.5 mol | $SiO_2$ Sol | 45 | 3 | Pear-skin georgette | 27 | Black | 13.0 |
| F-2 | DMI 8 mol | $SiO_2$ Sol | " | " | Pear-skin georgette | " | " | 13.2 |
| F-3 | PBT | $SiO_2$ Sol | " | " | Pear-skin georgette | " | " | 12.9 |
| F-4 | PET + PEG 5 mol Copolymer | $SiO_2$ Sol | " | " | Pear-skin georgette | " | " | 13.5 |
| F-5 | Nylon 66 | $SiO_2$ Sol | " | " | Pear-skin georgette | " | " | 13.0 |
| F-6 | PET | $SiO_2$ Sol | " | " | Pear-skin georgette | " | " | 13.4 |
| Comparison | | | | | | | | |
| F-7 | SIP 2.5 mol | $TiO_2$ | 200 | 0.45 | Pear-skin georgette | 27 | Black | 15.3 |
| F-8 | DMI 5 mol | $TiO_2$ | 200 | 0.08 | Pear-skin georgette | " | " | 15.4 |

TABLE 6-continued

| | | | | | | | | |
|---|---|---|---|---|---|---|---|---|
| F-9 | PBT | — | — | — | Pear-skin georgette | " | " | 14.8 |
| F-10 | PET + PEG 5 mol Copolymer | — | — | — | Pear-skin georgette | " | " | 15.4 |
| F-11 | Nylon 66 | $TiO_2$ | 200 | 0.3 | Pear-skin georgette | " | " | 15.2 |
| F-12 | PET | $TiO_2$ | 200 | 0.45 | Pear-skin georgette | " | " | 15.5 |

| | Plasma Conditions | | | | | |
|---|---|---|---|---|---|---|
| | Apparatus | Gas | Degree of Vacuum (Torr) | Output (W) | Irradiation Time (min) | Color Deepening Effect (L*) |
| Example | | | | | | |
| F-1 | Internal Electrode 13.56 MHz | Air | $10^{-2}$ | 50 | 7 | 6.0 |
| F-2 | Internal Electrode 13.56 MHz | " | " | " | " | 6.4 |
| F-3 | Internal Electrode 13.56 MHz | " | " | " | " | 5.7 |
| F-4 | Internal Electrode 13.56 MHz | " | " | " | " | 7.5 |
| F-5 | Internal Electrode 13.56 MHz | " | " | " | " | 6.1 |
| F-6 | Internal Electrode 13.56 MHz | " | " | " | " | 6.5 |
| Comparison | | | | | | |
| F-7 | Internal Electrode 13.56 MHz | Air | $10^{-2}$ | 50 | 7 | 11.7 |
| F-8 | Internal Electrode 13.56 MHz | " | " | " | " | 11.9 |
| F-9 | Internal Electrode 13.56 MHz | " | " | " | " | 11.2 |
| F-10 | Internal Electrode 13.56 MHz | " | " | " | " | 12.2 |
| F-11 | Internal Electrode 13.56 MHz | " | " | " | " | 11.8 |
| F-12 | Internal Electrode 13.56 MHz | " | " | " | " | 12.0 |

EXAMPLES G-1 TO G-4

Examples G-1 to G-4 (Table 7) show the effects on the color characteristics and durability produced by coating various low refractive index compositions on the fiber surface of the fabric obtained in Example A-7. The treatment conditions were as follows:

Treating Conditions (1)

Low Refractive Index Composition:

Tradename: Asahi Guard AG-710 supplied by Meisei Chemical (Flourine polymer emulsion chiefly comprising polytrifluoroalkyl acrylates; refractive index 1.38)

Padding Method;

50° C. Dipping—85% Draw ratio—100° C. Drying—170° C., 3 min Curing

Treating Conditions (2)

Low Refractive Index Composition:

Tradename: "Polon" MF-14D supplied by Shinetsu Chemical (Polysiloxane based emulsion chiefly comprising amino-modified silicone, refractive index 1.42)

Padding Method:

20° Dipping—80% Draw Radio—100° Drying—170° C., 1 min Curing

Treating Conditions (3)

Low Refractive Index Composition:

Perfluorobutene-2 (polymerized film 0.1μ; refractive index 1.38)

Plasma Polymerization Method:

Internal electrode type plasma apparatus

Frequency: 13.56 MHz

Gas introduced: Perfluorobutene-2 monomer

Degree of vacuum: 1 Torr

Output: 50 watts

Polymerization time: 7 minutes

TABLE 7

| | Treating Conditions | Fabric to be Treated | Deposit of Resin % | L* Value | | | |
|---|---|---|---|---|---|---|---|
| | | | | Before Treating | After Treating | After 3 Dry Cleanings | After 30 Washings |
| G-1 | (1) | A-7 | 0.5 | 10.0 | 9.4 | 9.4 | 9.6 |
| G-2 | (1) | " | 2.0 | " | 9.0 | 9.0 | 9.1 |
| G-3 | (2) | " | 2.0 | " | 9.6 | 9.7 | 9.7 |

TABLE 7-continued

| | Treating Conditions | Fabric to be Treated | Deposit of Resin % | L* Value Before Treating | After Treating | After 3 Dry Cleanings | After 30 Washings |
|---|---|---|---|---|---|---|---|
| G-4 | (3) | " | 0.1μ thick | " | 8.5 | 8.6 | 8.6 |

The color characteristics are expressed as the L* value obtained by a spectrophotometer, i.e. Hitachi's color analyzer Model 307. One cycle of test washing consisted of 10 minutes stirring in an ordinary washing machine using 1 g/l of a synthetic detergent (New Beads) at a water temperature of 45° C. and 10 minutes rinsing. For the resistance to dry cleaning, one test cycle consisted of washing using 100 ml of tetrachloroethylene, 1 g of "Emulgen" E-920, 1 g of "Neo Pelex" F-60, 0.1 ml of water and 20 stainless steel beads on a laundry tester at 30° C. for 30 minutes, then rinsing with tetrachloroethylene, and drying at 65° C. for 10 minutes.

What is claimed is:

1. A surface-modified synthetic fiber formed by plasma irradiating a synthetic fiber containing fine particles in which recesses and projections are formed on the surface of the synthetic fiber, said recesses being formed by being etched with plasma in the portion not shielded by the fine particles, said projections being formed by not being etched in the portion shielded by the fine particles, the synthetic fiber being imparted with a nondirectional irregular surface such that the distance between the center points of adjacent projections is between approximately 0.03 and 1 microns and the number of projections is between approximately 1 and 200 per square micron, said synthetic fiber containing 0.1–10% by weight of said fine particles, said fine particles having an average single particle size of less than 200 millimicrons prior to incorporation into said synthetic fiber, said fine particles being effective to impart said nondirectional irregular surface to said synthetic fiber upon plasma etching.

2. The surface-modified synthetic fiber of claim 1 wherein the fine particles are inorganic particles which are more unreactive and inert in a low-temperature plasma than the substrate of the synthetic fiber, and wherein at least some of the fine particles are silicon-containing inorganic particles, inorganic particles of an oxide of a Group II metal of the Periodic Table or a salt thereof, aluminum oxide, thorium oxide or zirconium oxide.

3. The surface-modified synthetic fiber of claim 1 wherein the surface of said fiber is coated with a thin film of a composition having a refractive index lower than that of the fiber.

4. A surface-modified synthetic fiber formed by plasma irradiating a synthetic fiber containing fine particles in a polymer substrate in which the substrate forms projections in a particulate form having the fine particles as cores on the surface of the fiber, the projections collectively create nondirectional irregularity on the surface of the fiber, and said irregularity is such that the distance between the center points of adjacent projections is between approximately 0.03 and 1 microns and the number of projections is between approximately 1 and 200 per square micron, said synthetic fiber containing 0.1–10% by weight of fine particles, said fine particles having an average single particle size of less than 200 millimicrons prior to incorporation into said polymer substrate, said fine particles being effective to impart said nondirectional irregularity in the surface of the fiber upon plasma irradiation.

5. The surface-modified synthetic fiber of claim 4 wherein the fine particles are inorganic particles which are more unreactive and inert in a low-temperature plasma than the substrate of the synthetic fiber and wherein at least some of the fine particles are silicon-containing inorganic particles, inorganic particles of an oxide of a Group II metal of the Periodic Table or a salt thereof, aluminum oxide, thorium oxide or zirconium oxide.

6. The surface-modified synthetic fiber of claim 4 wherein the surface of said fiber is coated with a thin film of a composition having a refractive index lower than that of the fiber.

* * * * *